US006956592B2

(12) United States Patent
Yamada et al.

(10) Patent No.: US 6,956,592 B2
(45) Date of Patent: Oct. 18, 2005

(54) GRAY-SCALE IMAGE DISPLAY DEVICE THAT CAN REDUCE POWER CONSUMPTION WHEN WRITING DATA

(75) Inventors: Kazuhiro Yamada, Takatsuki (JP); Isao Kawahara, Osaka-fu (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 420 days.

(21) Appl. No.: 09/840,667

(22) Filed: Apr. 23, 2001

(65) Prior Publication Data

US 2001/0033263 A1 Oct. 25, 2001

(30) Foreign Application Priority Data

Apr. 21, 2000 (JP) ..... 2000-121711

(51) Int. Cl.[7] ..... G09G 5/10
(52) U.S. Cl. ..... 345/691; 345/690
(58) Field of Search ..... 345/63, 55, 89, 345/90, 204, 690, 691, 693; 315/169.1

(56) References Cited

U.S. PATENT DOCUMENTS 5,898,414 A * 4/1999 Awamoto et al. ..... 345/55
6,025,818 A * 2/2000 Okano ..... 345/63
6,243,073 B1 * 6/2001 Kawamura et al. ..... 345/690
6,268,838 B1 * 7/2001 Kim ..... 345/63
6,407,506 B1 * 6/2002 Naka et al. ..... 315/169.1
6,448,960 B1 * 9/2002 Shigeta ..... 345/204

FOREIGN PATENT DOCUMENTS

EP 945844 A2 * 9/1999 ..... G09G 3/28
JP 10-187093 7/1998
JP 2000 66638 3/2000

* cited by examiner

*Primary Examiner*—Kent Chang

(57) ABSTRACT

In an image display device equipped with a panel having first and second electrodes, a field period is divided into a plurality of sub-field periods that each have a predetermined luminance weight, and a gray-scale image for is displayed by (a) writing sub-field image data of each sub-field period obtained by dividing input image data of the field period into the plurality of sub-field periods, into the panel through the first and second electrodes, and (b) sustaining an illumination state of ON or OFF in each cell for each sub-field period using luminance equivalent to a luminance weight of each sub-field period. The image display device includes an image changing unit for changing a part of sub-field image data of a predetermined sub-field period, so that a total number of charges and discharges performed on the first electrode when writing the sub-field image data becomes smaller.

18 Claims, 11 Drawing Sheets

FIG. 2

SUB-FIELD

8-BIT INPUT DIGITAL IMAGE SIGNAL

| | SF1 (128) | SF2 (64) | SF3 (32) | SF4 (16) | SF5 (8) | SF6 (4) | SF7 (2) | SF8 (1) | SF9 (0.5) |
|---|---|---|---|---|---|---|---|---|---|
| 0 | 0 | 0 | 0 | 0 | 0 | 0 | 0 | 0 | 0 |
| 1 | 0 | 0 | 0 | 0 | 0 | 0 | 0 | 1 | 0 |
| 2 | 0 | 0 | 0 | 0 | 0 | 0 | 1 | 0 | 0 |
| 3 | 0 | 0 | 0 | 0 | 0 | 0 | 1 | 1 | 0 |
| 4 | 0 | 0 | 0 | 0 | 0 | 1 | 0 | 0 | 0 |
| 5 | 0 | 0 | 0 | 0 | 0 | 1 | 0 | 1 | 0 |
| · | · | · | · | · | · | · | · | · | · |
| 65 | 0 | 1 | 0 | 0 | 0 | 0 | 0 | 1 | 0 |
| · | · | · | · | · | · | · | · | · | · |
| 253 | 1 | 1 | 1 | 1 | 1 | 1 | 0 | 1 | 0 |
| 254 | 1 | 1 | 1 | 1 | 1 | 1 | 1 | 0 | 0 |
| 255 | 1 | 1 | 1 | 1 | 1 | 1 | 1 | 1 | 0 |

0 · · · OFF
1 · · · ON

FIG. 6A

SF3 SUB-FIELD IMAGE

| | | | | | | | | | |
|---|---|---|---|---|---|---|---|---|---|
| * | * | * | * | * | * | * | * | * | * |
| * | * | * | * | * | * | * | * | * | * |
| * | * | * | * | * | * | * | * | * | * |
| * | * | * | 0 | 1 | 0 | 1 | * | * | * |
| * | * | * | 1 | 0 | 1 | 0 | * | * | * |
| * | * | * | 0 | 1 | 0 | 1 | * | * | * |
| * | * | * | 1 | 0 | 1 | 0 | * | * | * |
| * | * | * | * | * | * | * | * | * | * |
| * | * | * | * | * | * | * | * | * | * |
| * | * | * | * | * | * | * | * | * | * |

* = 0 OR 1

CHANGE

FIG. 6B

SF3 CHANGED SUB-FIELD IMAGE

| | | | | | | | | | |
|---|---|---|---|---|---|---|---|---|---|
| * | * | * | * | * | * | * | * | * | * |
| * | * | * | * | * | * | * | * | * | * |
| * | * | * | * | * | * | * | * | * | * |
| * | * | * | 0 | 0 | 0 | 0 | * | * | * |
| * | * | * | 0 | 0 | 0 | 0 | * | * | * |
| * | * | * | 0 | 0 | 0 | 0 | * | * | * |
| * | * | * | 0 | 0 | 0 | 0 | * | * | * |
| * | * | * | * | * | * | * | * | * | * |
| * | * | * | * | * | * | * | * | * | * |
| * | * | * | * | * | * | * | * | * | * |

LUMINANCE WEIGHT = "32"

FIG. 6C

SF4 CHANGED SUB-FIELD IMAGE

| | | | | | | | | | |
|---|---|---|---|---|---|---|---|---|---|
| * | * | * | * | * | * | * | * | * | * |
| * | * | * | * | * | * | * | * | * | * |
| * | * | * | * | * | * | * | * | * | * |
| * | * | * | 1 | 1 | 1 | 1 | * | * | * |
| * | * | * | 1 | 1 | 1 | 1 | * | * | * |
| * | * | * | 1 | 1 | 1 | 1 | * | * | * |
| * | * | * | 1 | 1 | 1 | 1 | * | * | * |
| * | * | * | * | * | * | * | * | * | * |
| * | * | * | * | * | * | * | * | * | * |
| * | * | * | * | * | * | * | * | * | * |

* = 0 OR 1 LUMINANCE WEIGHT = "16"

PATTERN IN SF3 WITH LUMINANCE WEIGHT OF "32" (MORE THAN HALF OF IMAGE IS CHECKERED)

BEFORE CHANGE

■ : ON

□ : OFF

DISPLAY SOLID IMAGE WITH LUMINANCE WEIGHT OF SF3 BEING DECREASED TO "16"

AFTER CHANGE

■ : ON

1100 DATA PULSE
1101 ILLUMINATION WAVEFORM ON DATA ELECTRODE Xm
1102 DISCHARGE ILLUMINATION WAVEFORM IN CELLS WHERE INFORMATION SHOULD BE WRITTEN
1110~1113 SCAN PULSE

GRAY-SCALE IMAGE DISPLAY DEVICE THAT CAN REDUCE POWER CONSUMPTION WHEN WRITING DATA

This application is based on application No. 2000-121711 filed in Japan, the content of which is hereby incorporated by reference.

BACKGROUND OF THE INVENTION (1) Field of the Invention

The present invention relates to a gray-scale image display device that performs data writing by sequentially scanning electrodes arranged in matrix.

(2) Related Art

Plasma display panels (PDPs), liquid crystal displays, electroluminescence displays, and the like are the types of matrix displays used in recent years. As an example, a three-electrode surface-discharge AC plasma display device performs data writing in the following manner.

As a method for driving a three-electrode surface-discharge PDP, the so-called address/surface discharge separation method, which separates a write period for writing information in cells to be illuminated and an illumination period for illuminating the cells in which the information has been written, is conventionally known, as disclosed in the Japanese Laid-Open Patent Application No. H07-271325. An operation of the address/discharge sustain separation method in the write period is briefly explained below.

In a PDP 1001 shown in FIG. 10, cells 1002 are the smallest illumination unit. A data electrode group 1003 is arranged vertically, in the order of $X_{m-1}$, $X_m$, and $X_{m+1}$ from left to light. A scan electrode group 1004 is arranged horizontally, in the order of $Y_0, Y_1, \ldots, Y_{n-1}, Y_n, Y_{n+1}$ and $Y_{n+2}$ from top to bottom. A sustain electrode group 1005 is arranged in parallel with the scan electrode group 1004. Each pair of scan and sustain electrodes performs sustain discharge in the illumination period. Note here that m and n are natural numbers.

In this PDP 1001, information is sequentially written starting from the cells positioned on the scan electrode $Y_0$, in the following manner.

First, a scan pulse is applied to the scan electrode $Y_0$, and at the same time a data pulse opposite in polarity to the scan pulse is applied to data electrodes corresponding to cells, among the cells present on the scan electrode $Y_0$, to which information should be written. As a result, the potential difference between the scan and data electrodes in the cells to which information should be written exceeds the discharge firing voltage of the scan and data electrodes, thereby causing a discharge called write discharge to occur in these cells. This write discharge in turn induces a discharge called data sustain discharge between the scan and sustain electrodes in the cells to which information should be written, as a result of which information is written in these cells. Here, the scan and data pulses are never applied simultaneously to the cells to which information is not to be written, so that no write discharge and therefore no data sustain discharge will occur in these cells.

After this, the same operation is performed sequentially on the scan electrodes $Y_1, Y_2, \ldots$, to the last scan electrode. Thus, scan pulses are applied to all lines.

FIG. 11 shows examples of voltage waveforms which are applied to various electrodes in the PDP 1001 shown in FIG. 10. In the drawing, a data pulse 1100 is applied to the data electrode $X_m$ when a scan pulse 1111 is being applied to the scan electrode $Y_n$, to write information only to the cells where the scan electrode $Y_n$ and the data electrode $X_m$ intersect with each other, i.e. cells 1006 diagonally shaded in FIG. 10. Also, a constant voltage is being applied to sustain electrodes throughout the write period.

This being so, when discharge illumination occurring on the data electrode $X_m$ is observed by an oscilloscope using a photodiode or similar by following the scan pulses which are sequentially applied from top to bottom, a waveform 1102 is obtained. This waveform 1102 shows illumination caused by write discharge and data sustain discharge occurring in the cells to which information is to be written. As can be seen from the drawing, discharge occurs only in the cells to which information should be written, while no discharge occurs in the cells to which information should not be written.

In such a matrix display, stray capacitances exist between neighboring data electrodes or between data and scan electrodes. A data electrode drive element charges/discharges these stray capacitances when selecting the cells to which information should be written, and thereby consumes power. A method for reducing the power consumption of the data electrode drive element is disclosed in Japanese Laid-Open Patent Application No. H11-282398. This method changes the order of selecting lines based on the input image data, the power consumption of the data electrode drive element, and the current flowing into the power supply terminal of the data electrode drive element, so as to minimize the power consumption of the data electrode drive element. Suppose horizontal lines are alternately displayed in a panel having 480 lines. If the lines are selected one at a time from top to bottom, the output of the data electrode drive element will end up being inverted 240 times for the 480 lines, so that the stray capacitances of each data electrode will be charged/discharged 240 times. However, if odd-number lines are selected one at a time from top to bottom and then even-number lines are selected one at a time from top to bottom, the output of the data electrode drive element will end up being inverted only once, so that the stray capacitances of each data electrode will be charged/discharged only once. Thus, the power consumption of the data electrode drive element is obviously lower in the latter case than in the former case.

Also, as the line capacity increases due to the recent trend toward high-definition displays, power consumed by charging/discharging electrodes tends to increase. Hence it is necessary to reduce this charge/discharge power consumption, in order to realize lower power consumption for displays.

To reduce the power consumption of the data electrode drive element, conventional techniques decrease the number of times the data electrode drive element is switched by, for example, changing the order of selecting lines for each image. According to this method, however, a simple shift register cannot be used as a scan electrode drive element, which causes complexity in circuit construction.

SUMMARY OF THE INVENTION

In view of the above problems, the present invention has an object of reducing power consumption of a data electrode drive circuit, without a loss of image quality or a complex circuit construction.

The stated object can be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including an image changing unit for changing a part of sub-field image data of a predetermined sub-field period, so that a total number of charges and discharges performed on the first electrode when writing the sub-field image data becomes smaller.

The stated object can also be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including an image changing unit for changing a part of sub-field image data of a predetermined sub-field period, so that a total amount of power supplied through the first electrode when writing the sub-field image data becomes smaller.

The stated object can also be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including an image changing unit for changing a part of sub-field image data of a predetermined sub-field period, so that adjacent cells in the first direction, which correspond to the part of the sub-field image data, are uniformly one of ON and OFF in the predetermined sub-field period.

The stated object can also be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including an image changing unit for changing, when a part of sub-field image data of a predetermined sub-field period has a higher spatial frequency than a predetermined value, the part of the sub-field image data so as to decrease the spatial frequency, while keeping average luminance of the part of the sub-field image data in the entire field period, within a certain range.

The stated object can also be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including an image changing unit for changing, when a part of sub-field image data of a predetermined sub-field period has a higher spatial frequency than a predetermined value, the part of the sub-field image data so that (a) cells corresponding to pixels which form the part of the sub-field image data are uniformly OFF in the predetermined sub-field period, and uniformly one of ON and OFF in a sub-field period having a smaller luminance weight than the predetermined sub-field period, if a luminance weight of the predetermined sub-field period is not the smallest luminance weight of the plurality of sub-field periods, and (b) the cells corresponding to the pixels which form the part of the sub-field image data are uniformly one of ON and OFF in the predetermined sub-field period, if the luminance weight of the predetermined sub-field period is the smallest luminance weight.

The stated object can also be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including: an image data storing unit for storing sub-field image data of each sub-field period; a pattern detecting unit for reading sub-field image data of a predetermined sub-field period from the image data storing unit, and detecting whether a part of the read sub-field image data has a specific pattern that causes a substantial increase in power consumption when writing the sub-field image data; and an image changing unit for, when the part of the sub-field image data having the specific pattern is detected by the pattern detecting unit, (a) reading the sub-field image data of the predetermined sub-field period from the image data storing unit, changing the part of the sub-field image data so that cells corresponding to pixels which form the part of the sub-field image data are uniformly OFF, and storing the changed sub-field image data back into the image data storing unit, and (b) reading sub-field image data of a sub-field period whose luminance weight is smaller than the predetermined sub-field period from the image data storing unit, changing a corresponding part of the read sub-field image data so that the cells corresponding to the pixels which form the corresponding part of the sub-field image data are uniformly ON, and storing the changed sub-field image data back into the image data storing unit.

The stated object can also be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including: an image data storing unit for storing sub-field image data of each sub-field period; a pattern detecting unit for reading sub-field image data of a predetermined sub-field period from the image dada storing unit, and detecting whether a part of the read sub-field image data has a specific pattern that causes a substantial increase in power consumption when writing the sub-field image data; a comparing unit for comparing, when the part of the sub-field image data having the specific pattern is detected by the pattern detecting unit, a number of pixels which form the part of the sub-field image data with a predetermined number; an image changing unit for (a) reading, when the number of pixels is no smaller than the predetermined number, the sub-field image data of the predetermined sub-field period from the image data storing unit, (b) changing the read sub-field image data so that cells corresponding to all pixels of the sub-field image data are uniformly ON, and (c) storing the changed sub-field image data back into the image data storing unit; and a luminance controlling unit for changing a luminance weight of the predetermined sub-field period, so that average luminance of the sub-field image data in the predetermined sub-field period is kept within a certain range.

With these constructions, the power required to drive the first electrode can be reduced.

For example, if image data of some sub-field has a short cycle of changing between ON and OFF in the first direction, the number of times the first electrode is charged and discharged increases, which causes an increase in power consumption when writing the sub-field image data. Also, when illuminating a cell that is adjacent in the second direction to a cell which is not to be illuminated, the write voltage is raised by several tens of volts than when illuminating a cell that is adjacent in the second direction to a cell which is to be illuminated, in order to compensate the effects by the electric field distributed in a small area and to appropriately write the data to the desired cell. In other words, if the cycle of changing between ON and OFF is short in the second direction too, the power consumption when writing the sub-field image data further increases. To reduce this power consumption, the invention changes the part of the sub-field image data before writing it into the panel.

As a result, the power consumption of the driver IC that drives the first electrode decreases, with it being possible to prevent the breakdown of the driver IC even when the current supply capacity of the driver IC is low. This allows a low-price product with a low current supply capacity to be used as the driver IC. Also, since the amount of heat generated from such a driver IC is low, radiator devices such as a heat sink and a fan can be reduced or miniaturized.

Here, when at least three adjacent cells in the first direction which correspond to the pixels that form the part of the sub-field image data of the predetermined sub-field period are inverted from each other, and if the luminance weight of the predetermined sub-field period is not the smallest luminance weight, the image changing unit may change the part of the sub-field image data so that the cells corresponding to the pixels which form the part of the sub-field image data are uniformly OFF in the predetermined sub-field period, and uniformly ON in the sub-field period having the smaller luminance weight.

Here, if the luminance weight of the predetermined sub-field period is the smallest luminance weight, the image changing unit may use an auxiliary sub-field period whose luminance weight is substantially one-half of the smallest luminance weight, and change the sub-field image data so that cells corresponding to all pixels which form the sub-field image data are uniformly OFF in the predetermined sub-field period, and uniformly ON in the auxiliary sub-field period.

With this construction, the auxiliary sub-field is employed exclusively for suppressing the change of luminance when the image data of the sub-field having the smallest luminance weight is changed. In so doing, the loss of image quality in dark image areas can be suppressed.

Here, when at least three adjacent cells in the first direction that correspond to the pixels which form the part of the sub-field image data of the predetermined sub-field period are inverted from each other, and if the luminance weight of the predetermined sub-field period is the smallest luminance weight, the image changing unit may change the part of the sub-field image data so that the cells corresponding to the pixels which form the part of the sub-field image data are uniformly OFF in the predetermined sub-field period.

Here, when at least three adjacent cells in the first direction that correspond to the pixels which form the part of the sub-field image data of the predetermined sub-field period are inverted from each other, and if the luminance weight of the predetermined sub-field period is the smallest luminance weight, the image changing unit may change the part of the sub-field image data so that the cells corresponding to the pixels which form the part of the sub-field image data are uniformly ON in the predetermined sub-field period.

A pattern such as the horizontal stripe pattern is made up of signals which change frequently in the first direction. Though such a pattern requires high power to drive the first electrode, it is desirable to display the pattern with as little changes as possible, so as to suppress deterioration in image quality. Accordingly, if the proportion of the pattern to the entire image is small enough not to exceed the current supply capacity of the driver IC, the pattern is displayed as it is, while if the proportion of the pattern to the entire image is large enough to exceed the current supply capacity of the driver IC, the pattern is changed to reduce the power required to drive the first electrode.

Here, when the part of the sub-field image data of the predetermined sub-field period has the higher spatial frequency than the predetermined value only in the first direction, the image changing unit may determine whether to change the part of the sub-field image data, depending on a proportion of a number of pixels which form the part of the sub-field image data to a total number of pixels which form the sub-field image data.

Here, the image changing unit may choose not to change the part of the sub-field image data, when the cells corresponding to the pixels which form the part of the sub-field image data are not inverted from each other in the second direction.

Here, the image changing unit may choose not to change the part of the sub-field image data, when the part of the sub-field image data has the higher spatial frequency only in the second direction.

The stated object can also be achieved by an image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device including an image changing unit for changing, when a part of sub-field image data of a predetermined sub-field period which is no smaller than one-half of the sub-field image data has a higher spatial frequency than a predetermined value, the sub-field image data so that cells corresponding to all pixels of the sub-field image data are uniformly ON in the predetermined sub-field period, while keeping average luminance of the sub-field image data in the predetermined sub-field period, within a certain range.

With this construction, the power required to drive the first electrode can be reduced.

As a result, the power consumption of the driver IC which drives the first electrode decreases, with it being possible to prevent the breakdown of the driver IC even when the current supply capacity of the driver IC is low. This allows a low-price product with a low current supply capacity to be used as the driver IC. Also, since the heat generated from such a driver IC is low, radiator devices such as a heat sink and a fan can be reduced or miniaturized.

Furthermore, when changing image data of one sub-field, there is no need to refer to image data of another sub-field, which enables the processing to be carried out more easily and speedily.

Here, the image changing unit may change the part of the sub-field image data or the sub-field image data, only when the predetermined sub-field period has a smaller luminance weight than a predetermined value.

With this construction, the loss of image quality can be minimized.

Here, the image changing unit may change the part of the sub-field image data or the sub-field image data, only when an amount of power required to drive the first electrode is greater than a predetermined value.

With this construction, when unnecessary the image data is not changed and therefore the image quality is not deteriorated. For instance, when the average luminance of the image data to be displayed is relatively large, the number of pixels or sub-fields to be illuminated is large. This being so, if the current supply capacity of the driver IC is low, the breakdown of the driver IC may occur. In such a case, the image data needs to be changed to reduce the power consumption, at the expense of image quality.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings:

FIG. 2 shows the contents of signal processing by a signal converting unit shown in FIG. 1;

FIG. 6 shows a schematic representation of an operation of the computing unit;

DESCRIPTION OF THE PREFERRED EMBODIMENT(S)

First Embodiment

An image display device according to the first embodiment of the present invention is explained below, with reference to the drawings.

The image display device in this embodiment uses an AC PDP, and displays a gray-scale image by expressing a gray level with a combination of the illumination states in each of a predetermined number (e.g. eight) of sub-fields which has a predetermined number of light emissions as a luminance weight. Though the following description concerns a monochrome panel in which one pixel is made up of one cell for ease of explanation, the invention can also be applied to a color display panel having three colors of red (R), green (G), and blue (B).

Figure 1:
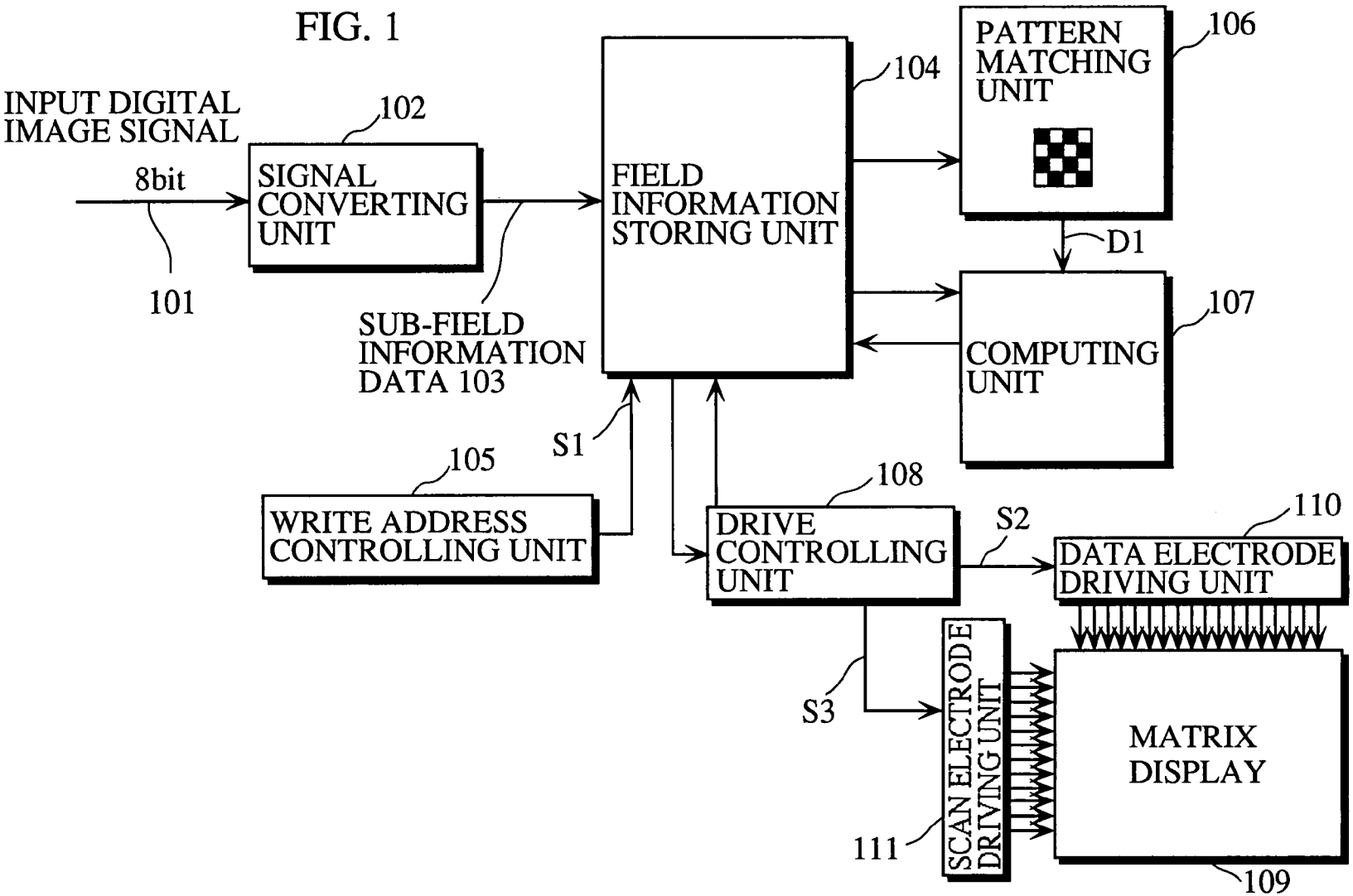
FIG. 1 is a block diagram showing a construction of an image display device according to the first embodiment of the present invention.

FIG. 1 is a block diagram showing a construction of the image display device to which the first embodiment of the invention relates.

In the drawing, the image display device includes a signal converting unit 102, a field information storing unit 104, a write address controlling unit 105, a pattern matching unit 106, a computing unit 107, a drive controlling unit 108, an AC PDP (matrix display) 109, a data electrode driving unit 110, and a scan electrode driving unit 111.

The signal converting unit 102 receives an input digital image signal 101 (8 bits) of each pixel, and converts the digital image signal 101 into field information 103 of, in this embodiment, 8 bits which each have a predetermined weight.

More specifically, each input image signal is divided into a predetermined number of sub-fields, based on a look-up table that associates the gray level of the input image signal with the information to which the image signal should be converted. This division for each pixel image signal is carried out in sync with a pixel clock generated by a PLL circuit (not illustrated).

The field information is a group of 1-bit sub-field information indicating which periods within one TV field period, i.e. sub-fields, should be illuminated. Such generated field information corresponding to each pixel is assigned a physical address by an addressing signal S1 outputted from the write address control circuit 105, and written into the field information storing unit 104 for each sub-field, pixel, line, and frame.

FIG. 2 shows the correspondence between gray levels of input image signals and information to which the input image signals should be converted, in the signal converting unit 102.

The drawing shows a table of correspondence between input image signal values and sub-field combinations after conversion, which is used for converting each input image signal into 8-bit field information of the ON/OFF states of sub-fields SF1–SF8 that have varying luminance weights of "128", "64", "32", "16", "8", "4", "2", and "1" in order of time. In the table, the leftmost column shows the values of the input digital image signals, whereas the remaining columns show 8-bit field information to which the input image signals should be converted. In the field information, "1" means the pixel is ON (illuminated) in the sub-field, and "0" means the pixel is OFF (not illuminated) in the sub-field (the same applies hereafter).

For instance, when an image signal is "65" (designated by the thick line box in FIG. 2), the signal converting unit 102 converts the image signal to 8-bit data "10000010" that shows the combination of the sub-fields with the luminance weights "64" and "1", and outputs the 8-bit data. The bits here are represented in such a way that digits in bit representation correspond to sub-field numbers.

Figure 3:
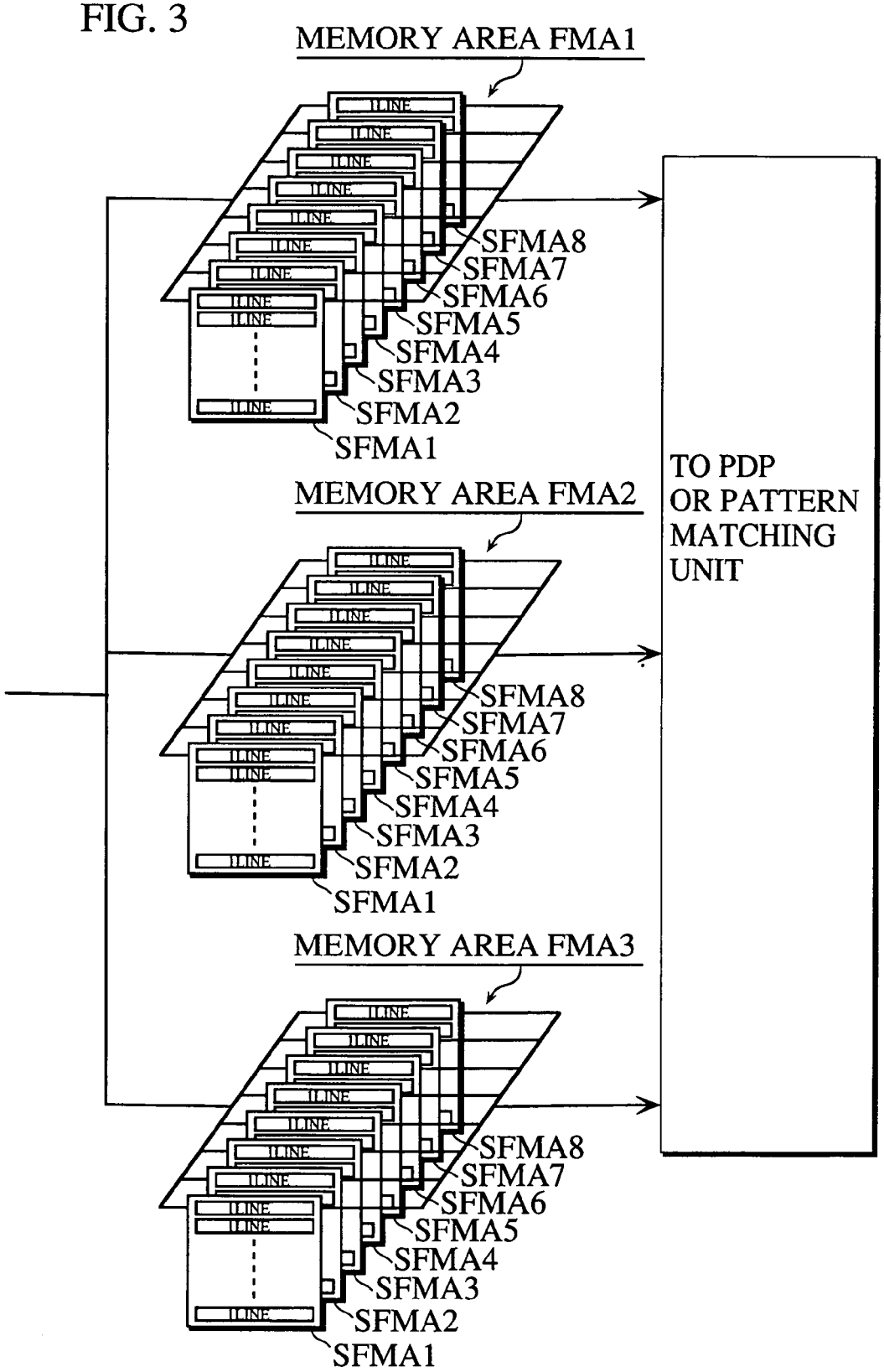
FIG. 3 shows an internal structure of a field information storing unit shown in FIG. 1.

The field information storing unit 104 is a frame memory having such a structure as shown in FIG. 3. In the drawing, the field information storing unit 104 is provided with three memory areas for storing field information for three consecutive frames, namely a first memory area FMA1 for storing field information for one frame, a second memory area FMA2 for storing field information for another frame, and a third memory area FMA3 for storing field information for yet another frame.

Each of the memory areas FMA1–FMA3 has eight sub-field memories SFMA1 to SFMA8 corresponding to the number of bits of field information. With this structure, field information showing a combination of sub-fields of 8 bits for each pixel is written in the sub-field memories SFMA1–SFMA8 as information concerning the ON/OFF states of the sub-fields, for three consecutive frames. In this embodiment, semiconductor memories of 1-bit input and 1-bit output are used as the sub-field memories SFMA1–SFMA8.

To store field information into the field information storing unit 104, the three memory areas FMA1–FMA3 are used in turn so that field information for one frame is stored in the first memory area FMA1, field information for the next frame is stored in the second memory area FMA2, and field information for a frame after the next is stored in the third memory area FMA3. To store field information into the first memory area FMA1 (or FMA2 or FMA3), a method is used that directs each bit of the 8-bit data, which is outputted from the signal converting unit 102 in sync with the pixel clock, to a different one of the eight sub-field memories SFMA1–SFMA8. Here, it is predetermined as to which bits in the 8-bit data should respectively be written to the sub-field memories SFMA1–SFMA8.

To be more specific, the sub-field numbers 1 to 8 in the signal converting unit 102 are logically associated with the sub-field memories SFMA1 to SFMA8 of the same numbers, and each bit of the 8-bit data is stored in one of the sub-field memories SFMA1–SFMA8, depending on which sub-field number each bit corresponds to. The storage position of the 8-bit data in the sub-field memories SFMA1–SFMA8 are specified by the addressing signal S1 from the write address controlling unit 105.

In this embodiment, the 8-bit data is written in the same position where the pixel signal before being converted to the 8-bit data is on the screen.

The drive controlling unit 108 reads, in the write period, field information from one of the memory areas FMA1–FMA3 in the field information storing unit 104, and serially outputs bit information corresponding to the number of cells to be displayed in one line, to the data electrode driving unit 110 as a write cell designation signal S2. The drive controlling unit 108 also indicates to the scan electrode driving unit 111 which line should be scanned, using a scan line designation signal S3.

Further, the drive controlling unit 108 indicates operation timings to each driving unit, in the set-up period for setting up the electric charge of the PDP 109, the sustain period for sustaining the illumination, and the erase period for erasing the electric charge of the PDP 109.

The data electrode driving unit 110 and the scan electrode driving unit 111 respectively receive the signals S2 and S3 from the drive controlling unit 108, generate pulse signals, and apply the pulse voltages to each electrode of the PDP 109. The data electrode driving unit 110 is equipped with shift registers, and simultaneously applies data pulses to data electrodes in bulk, based on the signal S2 which is serially outputted bit by bit.

The operation of reading field information from the memory areas FMA1–FMA3 by the drive controlling unit 108 is synchronized with the operation of writing field information into the memory areas FMA1–FMA3, in units of frames. Which is to say, the drive controlling unit 108 does not read from a memory area into which 8-bit data is being written or from which 8-bit data is to be read to the pattern matching unit 106, but reads from a memory area into which 8-bit data has already been written and from which 8-bit data does not need to be read to the pattern patching unit 106 or the computing unit 107.

The pattern matching unit 106 arranges sub-field information of each cell in the same way as the corresponding pixel on the screen, and detects whether the resulting image in the sub-field (hereafter "sub-field image") contains an image of a predetermined pattern (e.g. a checkered pattern or a horizontal stripe pattern). The pattern matching method employed here is not particularly limited. For example, a conventional method of detecting a pattern through a mask of a predetermined pattern (e.g. the checkered or horizontal stripe pattern) of a predetermined area (e.g. 2×2 pixels) may be used.

First, the pattern matching unit 106 reads field information for each pixel in units of sub-fields (such information is hereafter called "sub-field image information"), from a memory area into which field information is not being written and from which field information is not being read by the drive controlling unit 108. In other words, the pattern matching unit 106 reads information of a sub-field, sequentially from the sub-field memories SFMA1–SFMA8 of the ascending numbers.

Figure 4B:
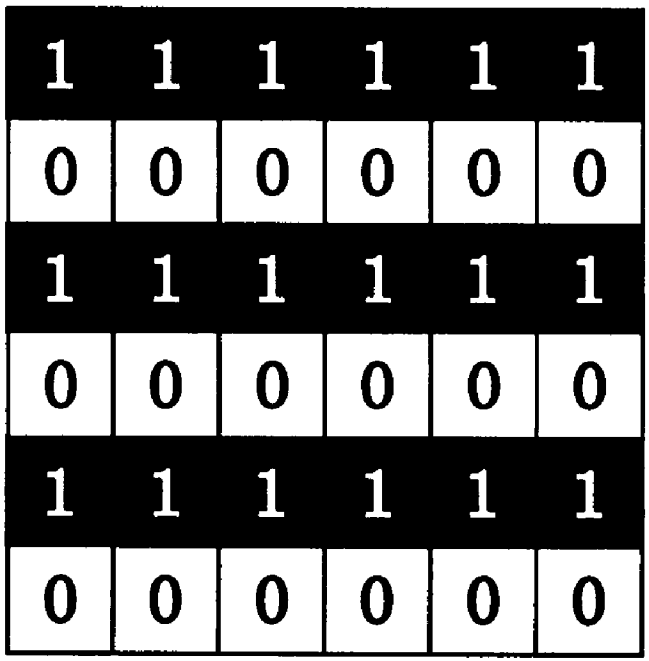
FIG. 4B shows a horizontal stripe pattern as another image pattern to be detected by the pattern matching unit.
Figure 4A:
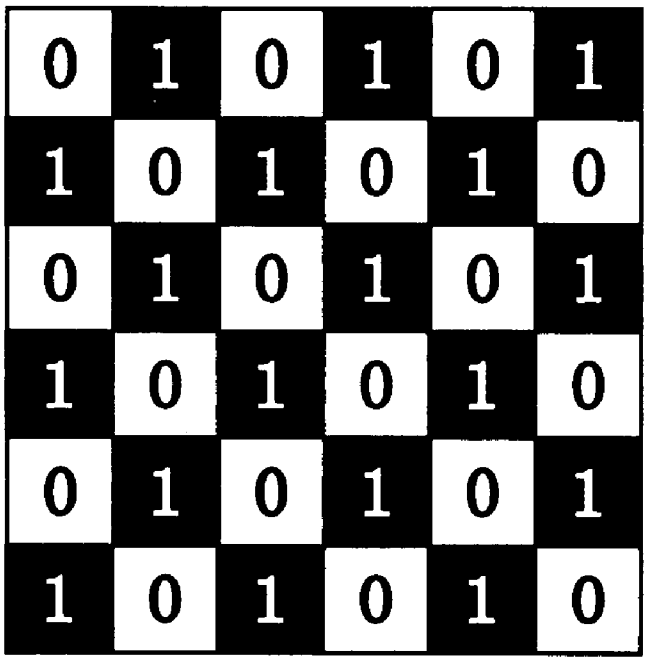
FIG. 4A shows a checkered pattern as an image pattern to be detected by a pattern matching unit shown in FIG. 1.

Predetermined patterns to be detected by the pattern matching unit 106 are such patterns that tend to cause relative increases in power when writing an electrostatic latent image to a PDP. In this embodiment, a checkered pattern where adjacent cells alternate between "0" and "1" as shown in FIG. 4A, and a horizontal stripe pattern where adjacent lines alternate between "0" and "1", are set as the predetermined patterns.

When one of the predetermined patterns is detected, the pattern matching unit 106 supplies information about the memory addresses of the pixels that form the detected pattern (i.e. address information D1 showing the storage positions of the pattern forming pixels in a sub-field memory), to the computing unit 107. The address information D1 shows the sub-field memory number and the matrix coordinate position in the sub-field memory.

The computing unit 107 reads the sub-field image information from the same sub-field memory read by the pattern matching unit 106. The computing unit 107 then changes the illumination state of the part of the read sub-field image information which is specified by the addresses shown by the address information D1 supplied from the pattern matching unit 106, uniformly to "0", and writes the changed sub-field image information back into the sub-field memory.

Following this, the computing unit 107 reads sub-field image information from a sub-field memory of the number next to the sub-field memory read by the pattern matching unit 106. The computing unit 107 then changes the part of the read sub-field image information corresponding to the addresses shown by the address information D1, uniformly to "1", and writes the changed sub-field image information back into the sub-field memory.

Thus, the computing unit 107 changes image data in units of sub-fields.

When no predetermined pattern is detected, the pattern matching unit 106 does not supply the address information D1 to the computing unit 107, so that the computing unit 107 will not perform the above operation. In such a case, the pattern matching unit 106 may supply the address information D1 which is blank to the computing unit 107, so that the computing unit 107 will not perform the operation on detecting that the address information D1 is blank.

It should be noted that in the process of reading sub-field image information in the ascending order of sub-field memory numbers, if sub-field information in a sub-field memory has already been changed by the computing unit 107, the pattern matching unit 106 reads the changed sub-field image information from the sub-field memory, except for the sub-field memory SFMA1 of the lowest number.

Figure 5:
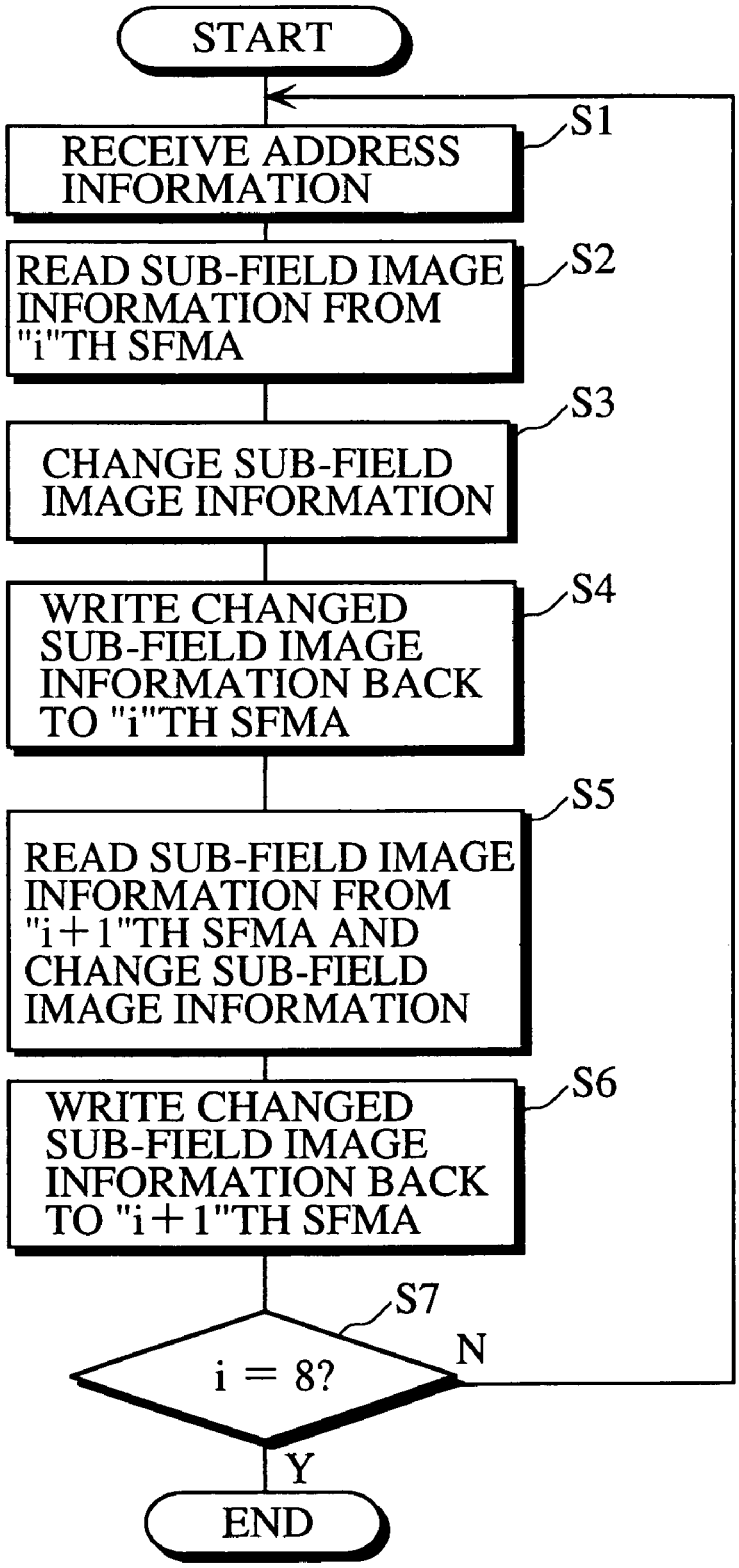
FIG. 5 is a flowchart showing an operation of a computing unit shown in FIG. 1.

The operation of the computing unit 107 is explained below, with reference to a flowchart shown in FIG. 5 and a schematic representation of image processing shown in FIG. 6.

The computing unit 107 receives the address information D1 from the pattern matching unit 106 (S1), and reads sub-field image information from the "i"th sub-field memory SFMA read by the pattern matching unit 106 (i is a natural number from 1 to 8) (S2).

The computing unit 107 changes the part of the read sub-field image information corresponding to the addresses specified by the address information D1, uniformly to "0", to generate changed sub-field image information (S3). The computing unit 107 then writes the changed sub-field image information back into the "i"th sub-field memory SFMA (S4).

The computing unit 107 further reads sub-field image information from the "i+1"th sub-field memory SFMA, and changes the part of the read sub-field image information corresponding to the addresses specified by the address information D1, uniformly to "1", to generate changed sub-field image information (S5). The computing unit 107 then writes the changed sub-field image information back into the "i+1" sub-field memory SFMA (S6).

The computing unit 107 judges whether the above operation has been performed for all sub-field memories SFMA1–SFMA8 (S7).

Suppose sub-field image information of sub-field SF3 forms a sub-field image shown in FIG. 6A. Then the computing unit 107 receives from the pattern matching unit 106 information about the memory addresses of the pixels (enclosed by the thick line box) having the checkered pattern, and changes the part of the sub-field image enclosed by the thick line box to an image having uniform luminance of "0" (OFF), as shown in FIG. 6B.

Further, the computing unit 107 changes the same part of the sub-field image of the next sub-field SF4, to an image having uniform luminance of "16" (ON), as shown in FIG. 6C.

Thus, it is possible to reduce the power consumption of the data electrode driving unit 110, while maintaining the average luminance of the entire field so as not to decrease image quality.

The reason why the power consumption of the data electrode driving unit 110 is reduced is that the number of times "ON" and "OFF" alternate in the vertical direction in a binary image displayed in a sub-field is greatly reduced when compared with the original image.

When performing this operation on sub-field image information stored in the sub-field memory of the highest number, the computation of step S5 is unnecessary, so that the part of the sub-field image information corresponding to the addresses specified by the address information D1 may be uniformly changed to not "0" but "1" in this case.

Alternatively, if sub-field SF9 having a luminance weight of "0.5" smaller than the luminance weight "1" is provided (as shown in the rightmost column of FIG. 2), it is possible to use an image of uniform luminance of "0" for sub-field SF8 and an image of uniform luminance of "0.5" for the next sub-field SF9. This procedure is substantially the same as the procedure in steps S4 and S5. Note here that such a sub-field SF9 with the luminance weight "0.5" is used as an auxiliary sub-field only when the computing unit 107 changes image data in units of sub-fields, and is not used for ordinary gray-scale display.

Figure 7A:
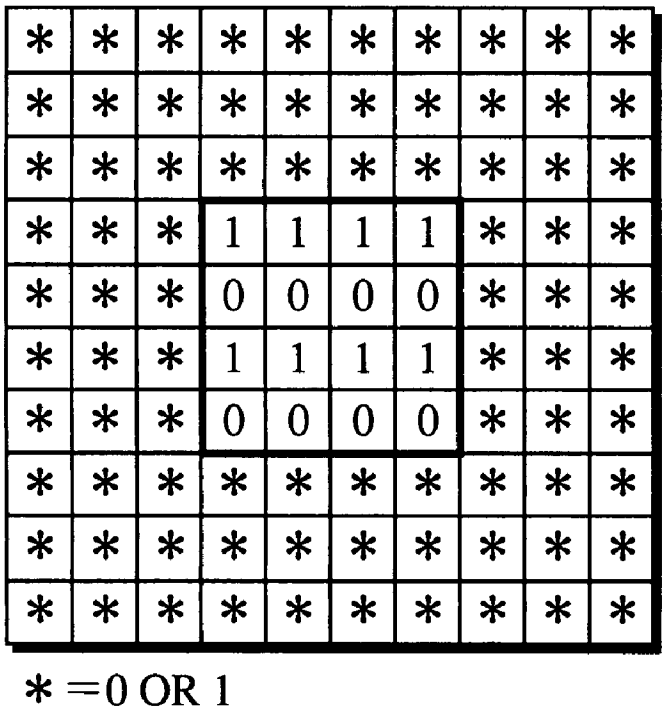
FIG. 7 shows a schematic representation of an exceptional operation of the computing unit.

The following is an explanation on exceptional processing when the pattern matching unit 106 detects a horizontal stripe pattern such as the one shown in FIG. 7A.

Figure 7B:
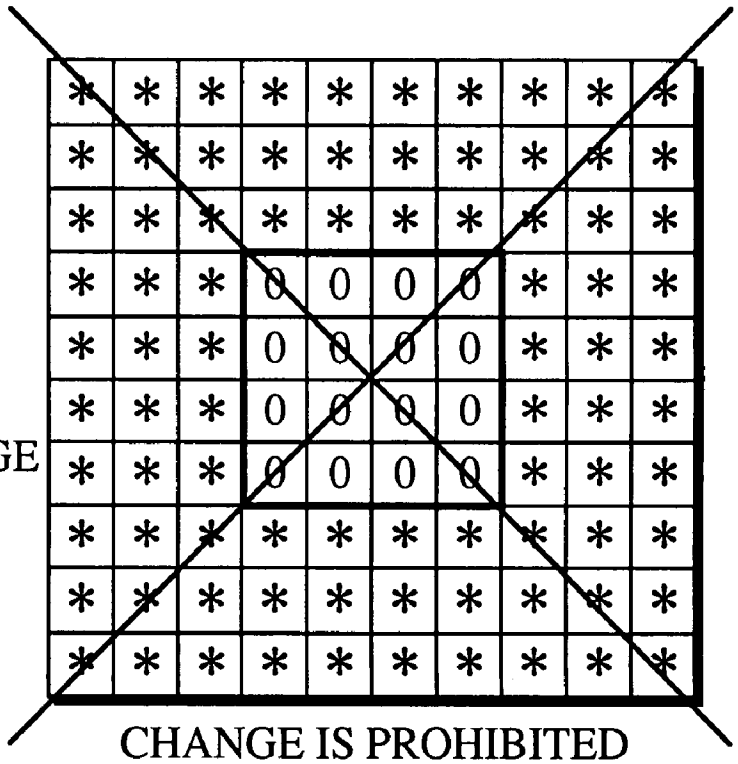

If the computing unit 107 changes the horizontal stripe pattern (designated by the thick line box) of the sub-field image shown in FIG. 7A to an image of uniform luminance, the change would be visually conspicuous since the human visual characteristic has low resolutions in the -diagonal direction but relatively high resolutions in the vertical direction. Therefore, it may be desirable not to change the pattern as shown in FIG. 7B, by way of exception. Such changes are especially conspicuous in sub-fields of high luminance weights, though they are not so conspicuous in sub-fields of low luminance weights.

Accordingly, the computing unit 107 may refer to the sub-field number of the sub-field image (i.e. refers to the luminance weight of the sub-field), and judge whether to change the image or not.

However, if the reduction of power required to drive data electrodes and the prevention of breakdown of the driver IC take top priority, the above horizontal stripe pattern image can be changed.

Alternatively, the computing unit 107 may judge whether to change the image, depending on the proportion of the area of the horizontal stripe pattern image to the area of the entire image. In so doing, the computing unit 107 maintains the horizontal stripe pattern as long as circumstances permit, but may change it if the load on the driver IC increases, thereby protecting the driver IC.

The above embodiment describes the case where the checkered pattern or the horizontal stripe pattern is detected by the pattern matching unit 106, but the invention is not limited to such. The same effects as the above embodiment can be obtained by changing an image in a sub-field which has such large spatial variations that cause increases in power required to drive data electrodes, to an image which has gentle spatial variations that cause little increases in the data electrode driving power, without greatly changing the average luminance of the image in the sub-field before the change.

The above embodiment describes the case where an image of a predetermined pattern in a sub-field is changed to an image of uniform luminance of "0", but the image of the predetermined pattern may instead be changed to an image of uniform luminance that is equivalent to the luminance weight of the sub-field. In this case, image quality would decrease to some extent as the average luminance is not given consideration. Such a problem can however be solved by controlling the display luminance in the sub-field, as shown in the second embodiment below.

Second Embodiment

An image display device according to the second embodiment of the invention is described below with reference to the drawings.

Figure 8:
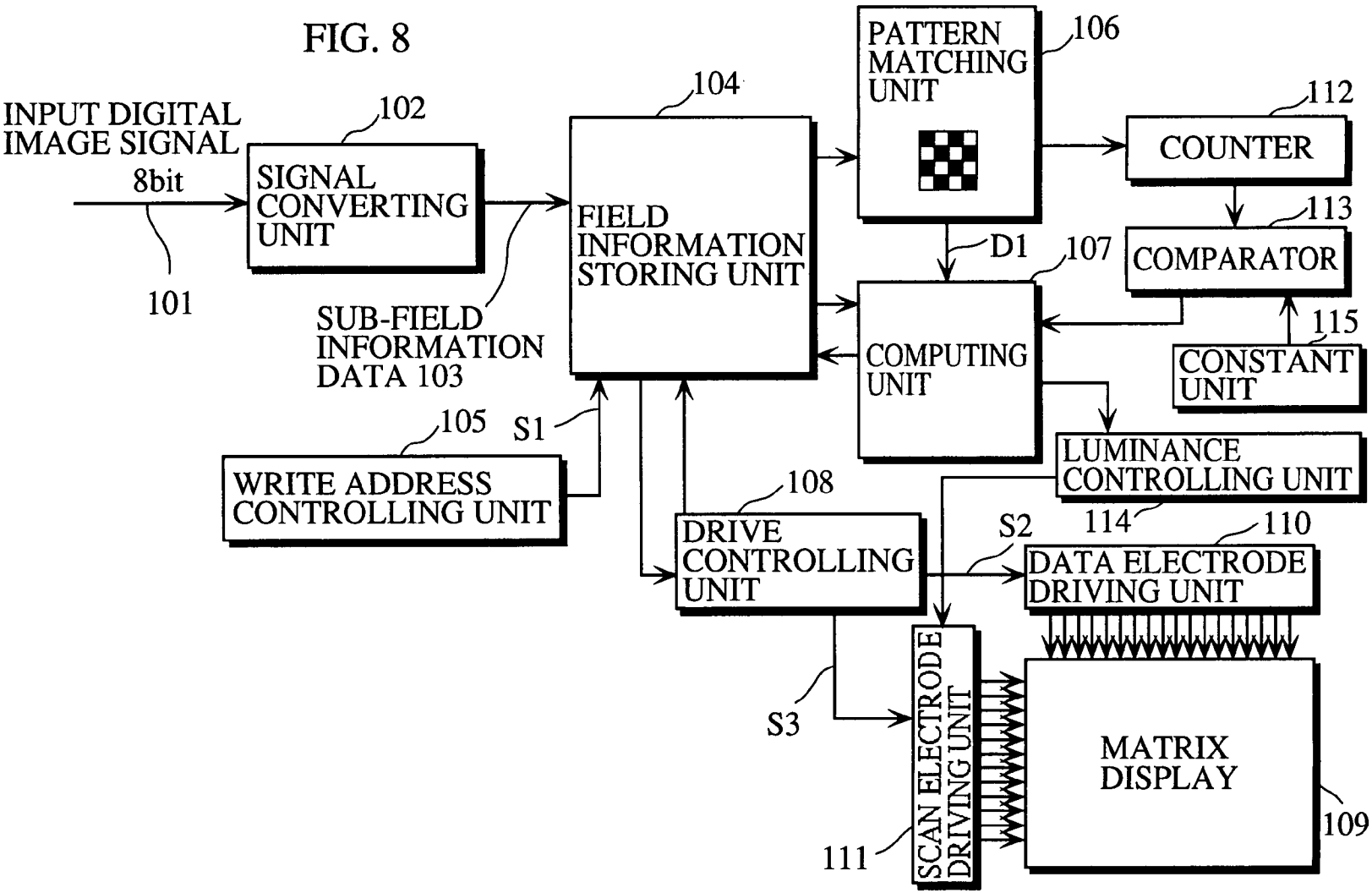
FIG. 8 is a block diagram showing a construction of an image display device according to the second embodiment of the invention.

FIG. 8 is a block diagram showing a construction of the image display device in the second embodiment. As illustrated, this image display device is provided with a counter 112, a comparator 113, a luminance controlling unit 114, and a constant unit 115, in addition to the construction elements of the first embodiment.

The pattern matching unit 106 reads sub-field image information from the field information storing unit 104, and detects whether the sub-field image information contains a predetermined pattern (the checkered pattern in this embodiment). The counter 112 counts the number of pixels which form the part of the sub-field image information having the predetermined pattern, and the comparator 113 compares the count number with a predetermined constant held in the constant unit 115. If the number of pixels which form the checkered pattern is no smaller than ½ of the total number of pixels, the computing unit 107 changes the illumination state of the entire sub-field image information to "1", and writes the changed sub-field image information back into the field information storing unit 104. Also, the luminance controlling unit 114 instructs the scan electrode driving unit 111 to decrease by half the original luminance weight of the sub-field. The scan electrode driving unit 111 accordingly applies half the number of sustain pulses, to decrease the luminance weight by half.

Figure 9A:
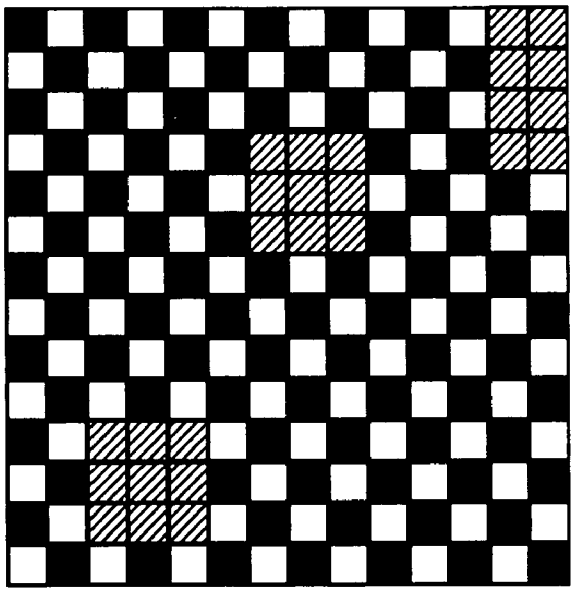
FIG. 9 is a schematic representation of an operation of a computing unit shown in FIG. 8.

FIG. 9 shows a specific example to explain this operation. Suppose a sub-field image of sub-field SF3 generated from an input digital image signal has a checkered pattern except for the diagonally shaded areas in a matrix display having the predetermined number of pixels, as shown in FIG. 9A.

Figure 9B:
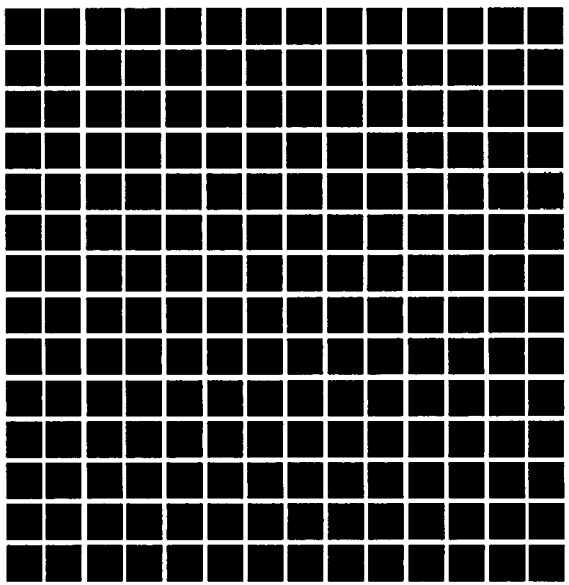
Figure 10:
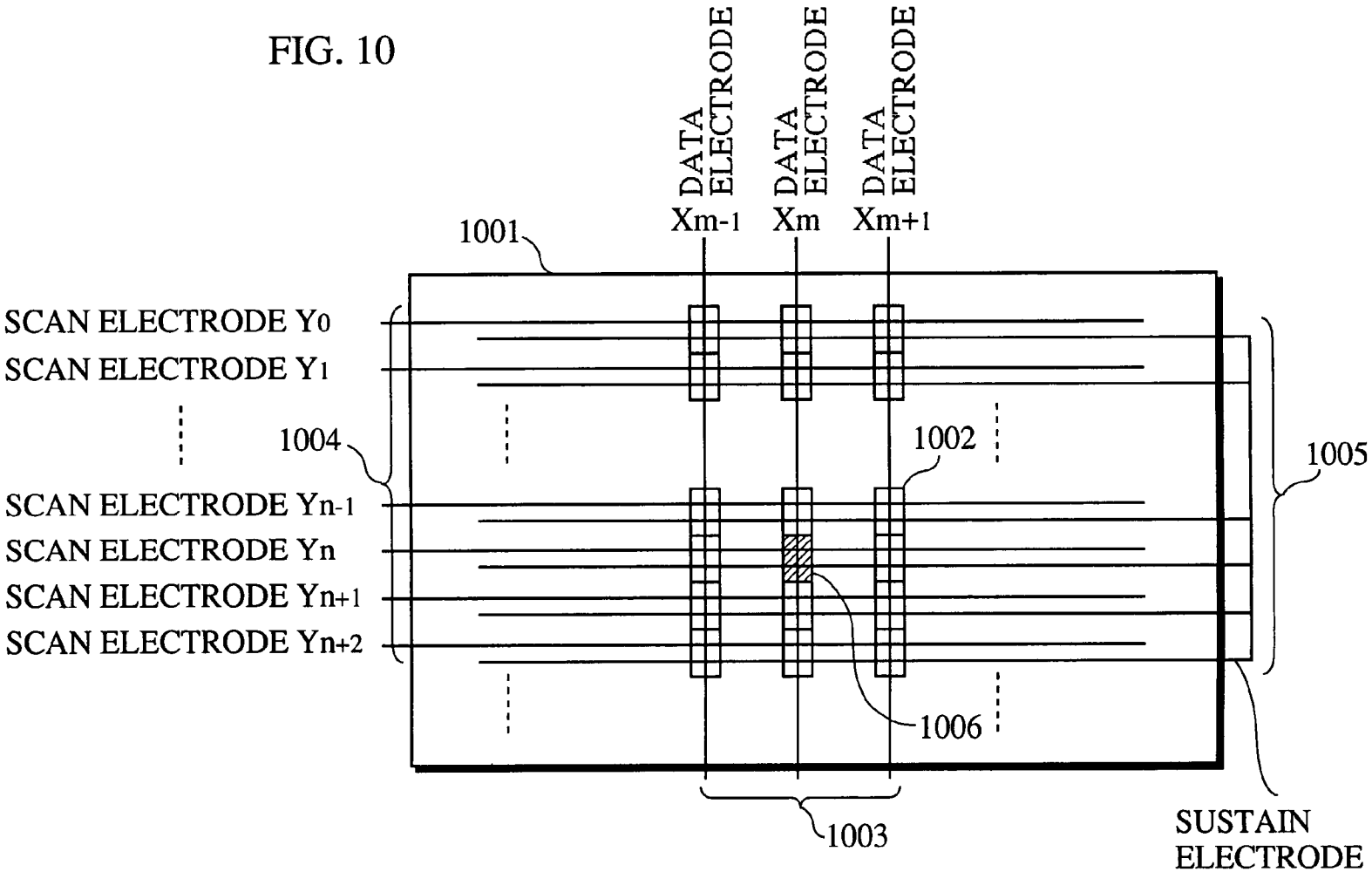
FIG. 10 is a plan view showing a construction of a PDP.
Figure 11:
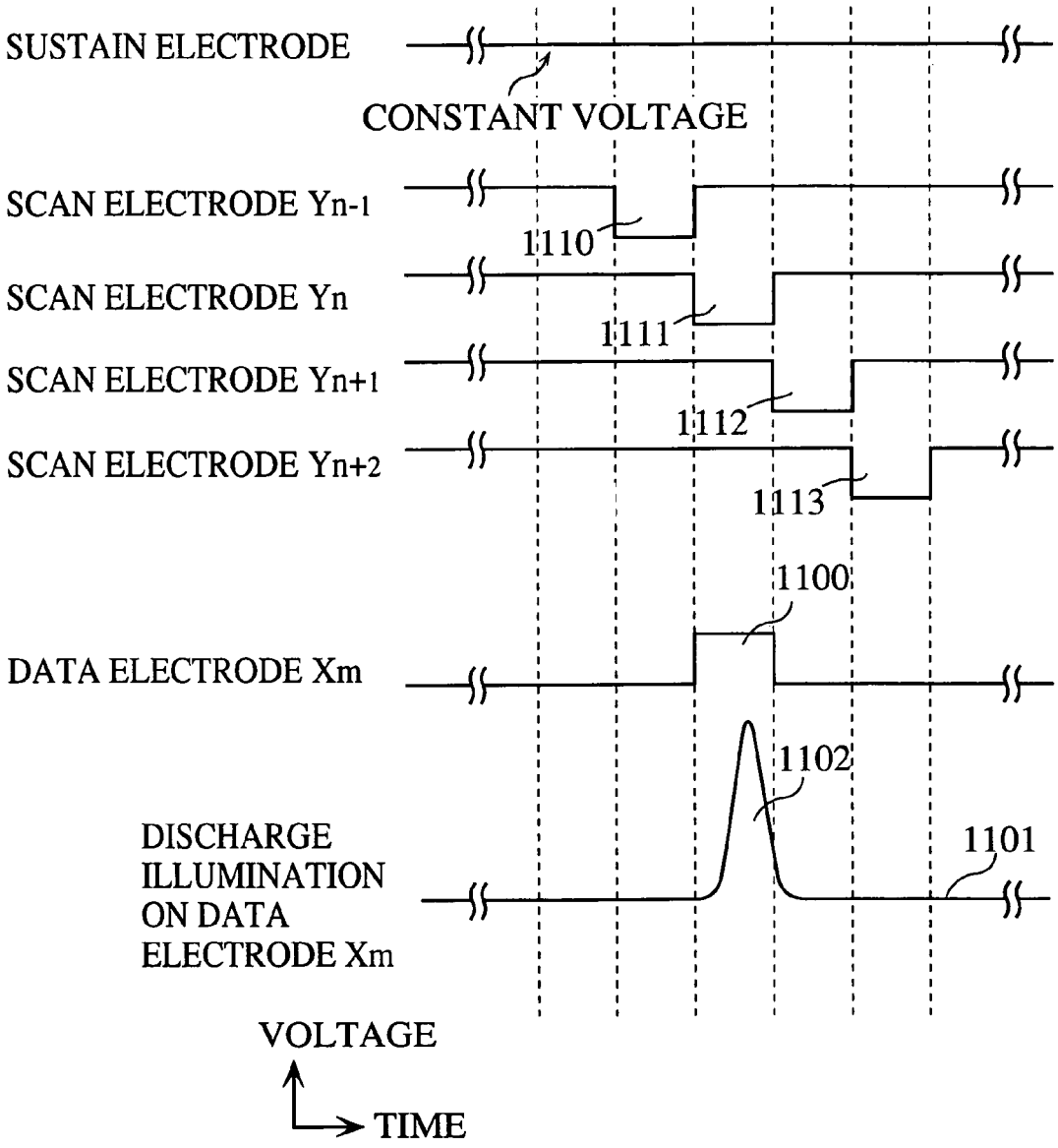
FIG. 11 shows voltage waveforms, to explain how data is written in the PDP shown in FIG. 10.

When almost the entire image has the checkered pattern as in this example, the entire sub-field image is changed to "1" (ON), and the luminance weight of sub-field SF3, which is originally "32", is reduced by half to "16", as shown in FIG. 9B.

With such an operation, the checkered pattern that requires high power consumption of the data electrode driving unit 110 is replaced with a solid pattern with low power consumption and half luminance. Since the human visual characteristic has low resolutions in the diagonal direction, even if the checkered pattern is changed to a solid image, the pre-changed image and the changed image appear similar in human eyes, so that image quality will not be significantly deteriorated.

In so doing, the power consumption of the data electrode driving unit 110 can be reduced.

Also, when changing image data of one sub-field, there is no need to refer to image data of another sub-field, so that each sub-field can be independently processed. This increases the processing speed.

The above embodiment describes the case where only the checkered pattern is detected by the pattern matching unit 106, but this is not a limit for the present invention. The same effects as the above embodiment can be obtained by changing a sub-field image which has such large spatial variations that cause increases in power required to drive data electrodes, to an image which has gentle spatial variations that cause little increases in the data electrode driving power, while changing the luminance of the sub-field so that the average luminance of the entire sub-field image in this sub-field is nearly equal to the average luminance before changing the image.

The operation of the computing unit 107 in the image display device described in this specification can be implemented by software. Which is to say, the operation of the computing unit 107 may be written in a program and executed on a computer.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device comprising an image changing unit for sequentially scanning cells adjacent in the second direction which is the vertical direction when driving the panel and for changing a part of sub-field image data of a predetermined sub-field period, so that a total number of charges and discharges performed on the first electrode when writing the sub-field image data becomes smaller.

2. An image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device comprising an image changing unit for sequentially scanning cells adjacent in the second direction which is the vertical direction when driving the panel and for changing a part of sub-field image data of a predetermined sub-field period, so that a total amount of power supplied through the first electrode when writing the sub-field image data becomes smaller.

3. An image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device comprising an image changing unit for changing, when a part of sub-field image data of a predetermined sud-field period has a higher spatial frequency than a predetermined value, the part of the sub-field image data so that (a) cells corresponding to pixels which form the part of the sub-field image data are uniformly OFF in the predetermined sub-field period, and uniformly one of ON and OFF in a sub-field period having a smaller luminance weight than the predetermined sub-field period, if a luminance weight of the predetermined sub-field period is not the smallest luminance weight of the plurality of sub-field periods, and (b) the cells corresponding to the pixels which form the part of the sub-field image data are uniformly one of ON and OFF in the predetermined sub-field period, if the luminance weight of the predetermined sub-field period is the smallest luminance weight.

4. The image display device of claim 3, wherein when at least three adjacent cells in the first direction which correspond to the pixels that form the part of the sub-field image data of the predetermined sub-field period are inverted from each other, and if the luminance weight of the predetermined sub-field period is not the smallest luminance weight, the image changing unit changes the part of the sub-field image data so that the cells corresponding to the pixels which form the part of the sub-field image data are uniformly OFF in the predetermined sub-field period, and uniformly ON in the sub-field period having the smaller luminance weight.

5. The image display device of claim 3, wherein if the luminance weight of the predetermined sub-field period is the smallest luminance weight, the image changing unit uses an auxiliary sub-field period whose luminance weight is substantially one-half of the smallest luminance weight, and changes the sub-field image data so that cells corresponding to all pixels which form the sub-field image data are uniformly OFF in the predetermined sub-field period, and uniformly ON in the auxiliary sub-field period.

6. The image display device of claim 3, wherein when at least three adjacent cells in the first direction that correspond to the pixels which form the part of the sub-field image data of the predetermined sub-field period are inverted from each other, and if the luminance weight of the predetermined sub-field period is the smallest luminance weight, the image changing unit changes the part of the sub-field image data so that the cells corresponding to the pixels which form the part of the sub-field image data are uniformly OFF in the predetermined sub-field period.

7. The image display device of claim 3, wherein when at least three adjacent cells in the first direction that correspond to the pixels which form the part of the sub-field image data of the predetermined sub-field period are inverted from each other, and if the luminance weight of the predetermined sub-field period is the smallest luminance weight, the image changing unit changes the part of the sub-field image data so that the cells corresponding to the pixels which form the part of the sub-field image data are uniformly ON in the predetermined sub-field period.

8. The image display device of claim 3, wherein when the part of the sub-field image data of the predetermined sub-field period has the higher spatial frequency than the predetermined value only in the first direction, the image changing unit determines whether to change the part of the sub-field image data, depending on a proportion of a number of pixels which form the part of the sub-field image data to a total number of pixels which form the sub-field image data.

9. The image display device of claim 8, wherein the image changing unit does not change the part of the sub-field image data, when the cells corresponding to the pixels which form the part of the sub-field image data are not inverted from each other in the second direction.

10. The image display device of claim 8, wherein the image changing unit does not change the part of the sub-field image data, when the part of the sub-field image data has the higher spatial frequency only in the second direction.

11. The image display device of one of claims 1, 2, and 3, wherein the image changing unit changes the part of the sub-field image data or the sub-field image data, only when the predetermined sub-field period has a smaller luminance weight than a predetermined value.

12. The image display device of one of claims 1, 2, and 3, wherein the image changing unit changes the part of the sub-field image data or the sub-field image data, only when an amount of power required to drive the first electrode is greater than a predetermined value.

13. An image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device comprising:

image data storing means for storing sub-field image data of each sub-field period;

pattern detecting means for reading sub-field image data of a predetermined sub-field period from the image data storing means, and detecting whether a part of the read sub-field image data has a specific pattern that causes a substantial increase in power consumption when writing the sub-field image data; and image changing means for, when the part of the sub-field image data having the specific pattern is detected by the pattern detecting means, (a) reading the sub-field image data of the predetermined sub-field period from the image data storing means, changing the part of the sub-field image data so that cells corresponding to pixels which form the part of the sub-field image data are uniformly OFF in the predetermined sub-field period, and storing the changed sub-field image data back into the image data storing means, and (b) reading sub-field image data of a sub-field period whose luminance weight is smaller than the predetermined sub-field period from the image data storing means, changing a corresponding part of the read sub-field image data so that the cells corresponding to the pixels which form the corresponding part of the sub-field image data are uniformly ON in the sub-field period, and storing the changed sub-field image data back into the image data storing means.

14. An image display device including a panel having a first electrode which extends in a first direction to write image data and a second electrode which extends in a second direction to select a display line, wherein a field period is divided into a plurality of sub-field periods that each have a predetermined luminance weight, and a gray-scale image for the field period is displayed by (a) writing sub-field image data of each sub-field period obtained by dividing input image data of the field period into the plurality of sub-field periods, into the panel through the first electrode and the second electrode, and (b) sustaining an illumination state of ON or OFF in each cell for each sub-field period using luminance equivalent to a luminance weight of each sub-field period, based on the written sub-field image data, the image display device comprising:

image data storing means for storing sub-field image data of each sub-field period;

pattern detecting means for reading sub-field image data of a predetermined sub-field period from the image dad a storing means, and detecting whether a part of the read sub-field image data has a specific pattern that causes a substantial increase in power consumption when writing the sub-field image data;

comparing means for comparing, when the part of the sub-field image data having the specific pattern is detected by the pattern detecting means, a number of pixels which form the part of the sub-field image data with a predetermined number;

image changing means for (a) reading, when the number of pixels is no smaller than the predetermined number, the sub-field image data of the predetermined sub-field period from the image data storing means, (b) changing the read sub-field data so that cells corresponding to all pixels of the sub-field image data are uniformly ON in the predetermined sub-field period, and (c) storing the changed sub-field image data back into the image data storing means; and luminance controlling means for changing a luminance weight of the predetermined sub-field period, so that average luminance of the sub-field image data in the predetermined sub-field period is kept within a certain range.

15. The image display of claim 2, wherein the image changing unit changes the part of the sub-field image data or the sub-field image data, only when the predetermined sub-field period has a smaller luminance weight that a predetermined value.

16. The image dislay of claim 3, wherein the image changing unit changes the part of the sub-field image data or the sub-field image data, only when the predetermined sub-field period has a smaller luminance weight than a predetermined value.

17. The image display device of claim 2, wherein the image changing unit changes the part of the sub-field image data or the sub-field image data, only when an amount of power required to drive the first electrode is greater that a predetermined value.

18. The image display device of claim 3, wherein the image changing unit changes the part of the sub-field image data or the sub-field image data, only when an amount of power required to drive the first electrode is greater than a predetermined value.

* * * * *

UNITED STATES PATENT AND TRADEMARK OFFICE

CERTIFICATE OF CORRECTION

PATENT NO. : 6,956,592 B2
APPLICATION NO. : 09/840667
DATED : October 18, 2005
INVENTOR(S) : Kazuhiro Yamada et al.

It is certified that error appears in the above-identified patent and that said Letters Patent is hereby corrected as shown below:

Column 15, line 62, “sud-field” should be -- sub-field --.
Column 18, lines 17-18, the words “dad a” should be -- data --.
Column 18, line 45, “that” should be -- than --.
Column 18, line 56, “that” should be -- than --.

Signed and Sealed this

Twelfth Day of September, 2006

JON W. DUDAS
*Director of the United States Patent and Trademark Office*